US005121966A

United States Patent [19]

Tischler

[11] Patent Number: 5,121,966

[45] Date of Patent: Jun. 16, 1992

[54] ADJUSTABLE RECLINER CHAIR

[76] Inventor: Ludwig J. Tischler, 2401 Cedar Key, Lake Orion, Mich. 48360

[21] Appl. No.: 602,019

[22] Filed: Oct. 23, 1990

[51] Int. Cl.[5] ..... A47C 3/03

[52] U.S. Cl. ..... 297/269; 297/270; A47C/3/03

[58] Field of Search ..... 297/269, 270; 248/412

[56] References Cited

U.S. PATENT DOCUMENTS

| | | | |
|---|---|---|---|
| 1,080,911 | 12/1913 | Hume | 248/412 |
| 2,606,594 | 8/1952 | Caldemeyer | 297/269 |
| 2,727,561 | 12/1955 | Bank et al. . | |
| 2,999,719 | 9/1961 | Schliephacke . | |
| 3,096,121 | 7/1963 | Knabusch et al. | 297/269 |
| 3,244,448 | 4/1966 | Re . | |
| 3,339,971 | 9/1967 | Fletcher . | |
| 3,434,755 | 6/1969 | Caldemeyer et al. | 297/269 |
| 4,307,912 | 12/1981 | Watt et al. . | |
| 4,367,895 | 1/1983 | Pacitti et al. . | |
| 4,437,701 | 3/1984 | Mizelle . | |
| 4,477,118 | 10/1984 | Ruble . | |
| 4,861,100 | 10/1989 | Baccaro . | |

*Primary Examiner*—Peter R. Brown
*Attorney, Agent, or Firm*—Alex Rhodes

[57] ABSTRACT

An adjustable recliner chair having a movable body support unit including a seat and back rest mounted on a stationary base, cooperative rocking structure disposed between the body support unit and the base, and a mechanism for providing two operating modes, namely, a reliner mode wherein the body support unit can be positioned between upright and fully reclined positions and a rocking mode wherein the body support unit can be rocked back and forth on the base. The adjusting mechanism is comprised of: a slender upward extending arcuate member pivotally mounted on the base; a cam pivotally mounted on the seat and back rest assembly, rearwards adjacent to the upward extending base mounted member; and an operating control mechanism for bringing the cam into locking and unlocking relationship to the arcuate member. The operating control mechanism includes a hand lever pivotally mounted in the base, and a linkage for interconnecting the hand lever with the cam.

14 Claims, 3 Drawing Sheets

ADJUSTABLE RECLINER CHAIR

BACKGROUND OF THE INVENTION

This invention relates to chairs for homes and more particularly to a recliner chair having a body support unit, including a seat and back rest assembly which is adjustable on a stationary base between an upright position and a fully reclined position. Recliner chairs are well known in the art. They allow an occupant of the chair the choice of upright and reclined positions. Some serve a dual purpose by also providing a rocker mode wherein the body support unit is released from the base for rocking back and forth on the base.

One deficiency in the prior art is that many recliner chairs provide limited choices for positioning the body support unit on the base, in many cases, only two are available, namely, an upright position and a fully reclined position. This restricts the utility of a recliner chair, and is particularly limiting when an occupant is watching television or conversing with others. In those chairs which are adjustable between the upright and fully reclined positions, their operating mechanisms are either complex, costly, of limited adjustment or functionally deficient.

Schliephacke U.S. Pat. No. 2,999,719 and Re' U.S. Pat. No. 3,244,448 are exemplary of the prior art. Schliephacke discloses a recliner chair having only two choices for positioning a body support unit on a stationary base, i.e., an upright position and a fully reclining position. Re' discloses a recliner chair, including a complex mechanism for adjusting a body support on a stationary base with neither positive means for fixing the body support unit on the base nor self adjusting means to compensate for normal wear.

With the foregoing in mind, it is apparent that there is a need for improvements in recliner chairs.

SUMMARY OF THE INVENTION

It is a primary object of the present invention to provide an economical recliner which is fully adjustable between upright and fully reclined positions. It is another object, in addition to the foregoing object, to provide in a recliner chair a means for compensating for normal wear. It is still another object to provide in a recliner chair an improved means for locking and unlocking a body support unit on a stationary base which is applicable to recliner chairs with and without a rocker feature.

The invention resides in the mechanism for locking and unlocking a movable body support unit mounted on a stationary base, which itself is believed to be novel, as well as the recliner chair which incorporates this mechanism.

The recliner chair has a body support unit including a seat and back rest mounted on a stationary base, cooperative rocking structure disposed between the body support unit and the base, and a mechanism for selectively providing two operating modes, namely, a recliner mode wherein the body support unit can be positioned between upright and fully reclined positions and a rocking mode wherein the body support unit can be rocked back and forth on the base. The adjusting mechanism is comprised of: a hand lever pivotally mounted on the base, and an operating mechanism, including a slender upward extending arcuate member pivotally mounted on the base; a cam pivotally mounted on the seat and back rest assembly, rearwards adjacent to the upward extending base mounted member, a reaction member mounted on the body support unit forwardly adjacent to the arcuate base mounted member, and an operating linkage, interconnecting the hand lever with the cam, for engaging and disengaging the cam with the upward extending base mounted member to lock and release the seat and back rest on the base.

One feature of the invention is that the adjusting mechanism is self-adjusting to compensate for normal wear of the cam and base mounted arcuate member. Another feature is that the body support unit can be adjusted to any angle between the upright and fully reclining positions.

Further features and benefits of the invention will become apparent from the ensuing description and accompanying drawings which describe the invention in detail.

DESCRIPTION OF THE PREFERRED EMBODIMENT

Figures 1, 2, 3, 4, 5, 6:
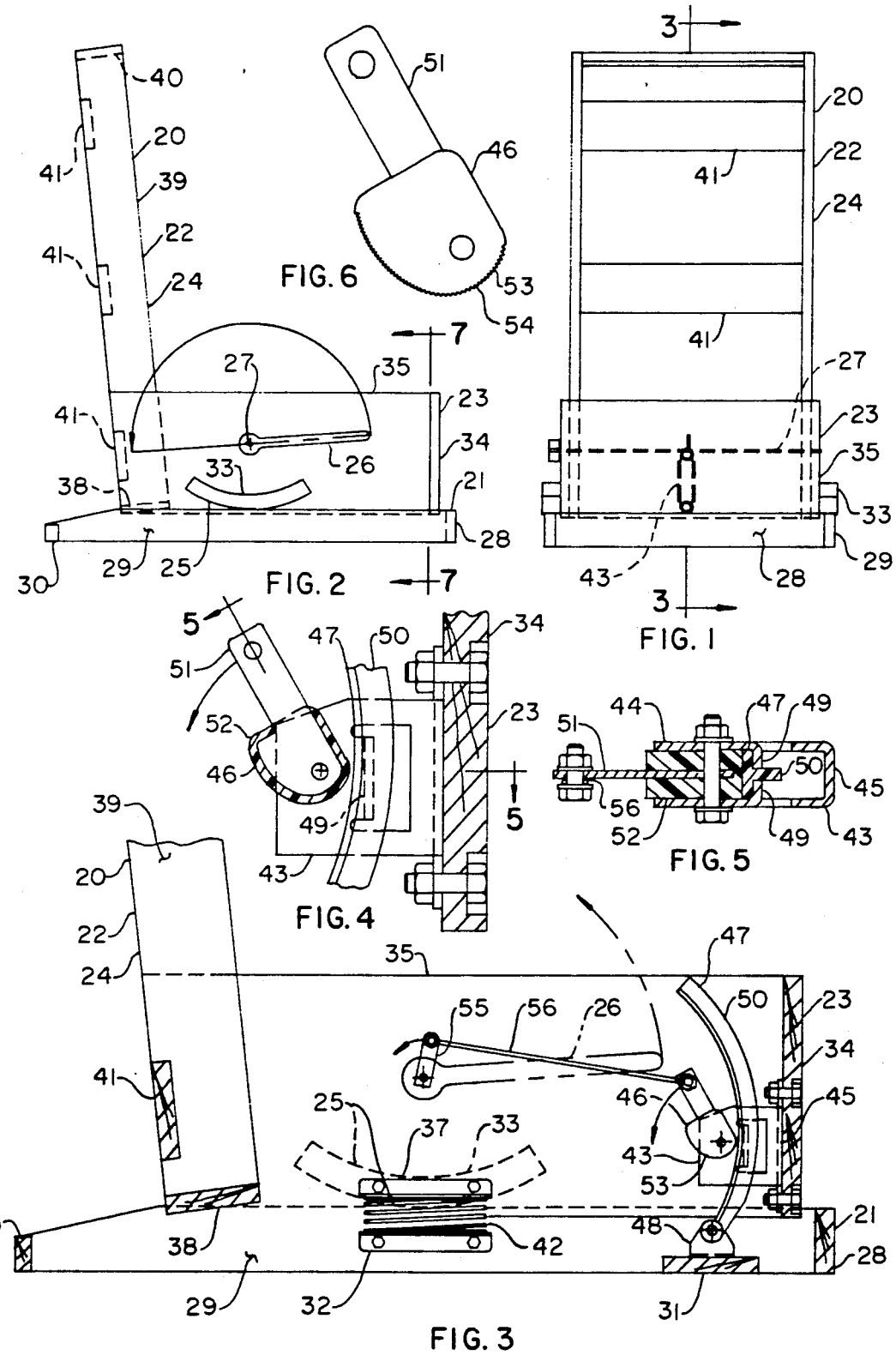
FIG. 1 is a front view of an adjustable recliner chair with upholstery and springs removed which embodies the present invention.
FIG. 2 is a side view of the recliner chair shown in FIG. 1.
FIG. 3 is a cross-sectional view drawn to an enlarged scale, taken on the line 3—3 in FIG. 1 showing a mechanism for adjusting the angle of the seat and back rest assembly in a released state.
FIG. 4 is a partial fragmentary view drawn to an enlarged scale of FIG. 3.
FIG. 5 is a cross-sectional view taken on the line 5—5 in FIG. 4.
FIG. 6 is an enlarged view of a cam which is part of the seat angle adjusting mechanism.
Figure 7:
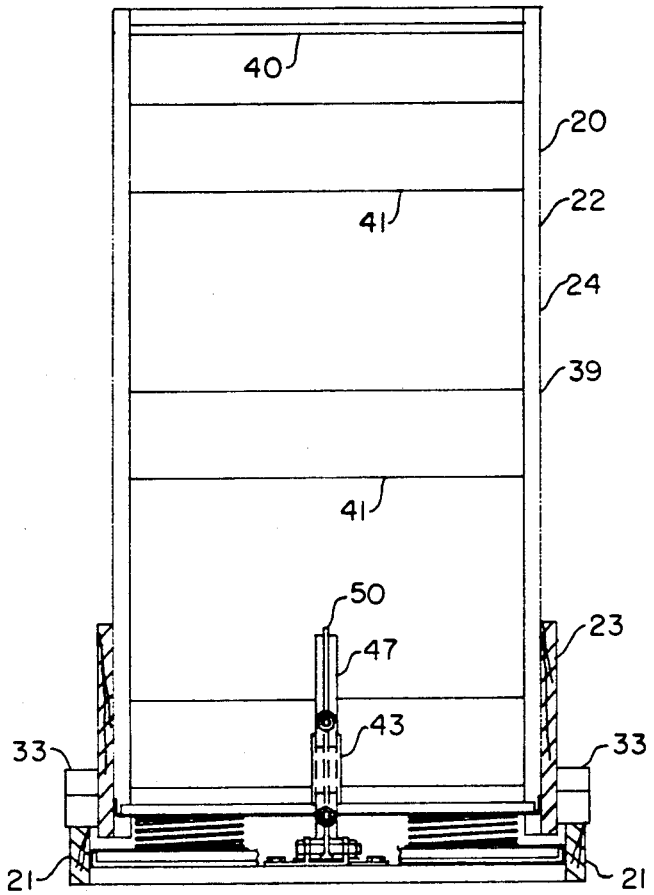
FIG. 7 is a cross-sectional view drawn to an enlarged scale taken on the line 7—7 of FIG. 3.

Referring now to the drawings wherein like numerals designate like and corresponding parts throughout the several views, an adjustable recliner chair is shown with upholstery and springs removed therein for purposes of illustrating my invention. The recliner chair, designated generally by the numeral 20, is comprised of a stationary base 21; a body support unit 22, including a seat 23 and back rest 24, mounted on the base 21; rocker structure 25 disposed between the body support unit 22 and the base 21; and a means for providing two operating modes, namely, a recliner mode wherein the body support unit 22 can be positioned between upright and fully reclined positions on the base 21 and a rocking mode wherein the body support unit can be rocked back and forth on the base 21.

Figure 8:
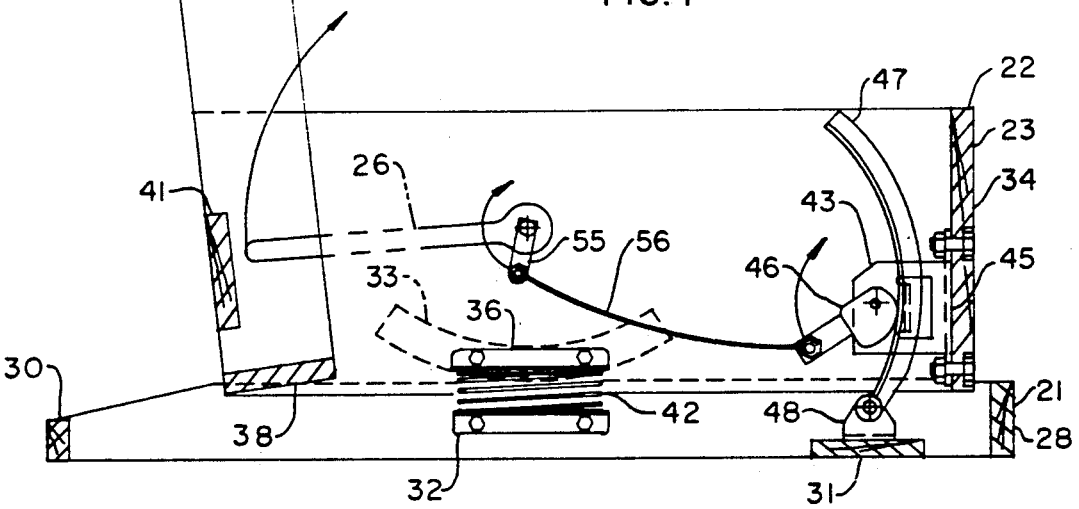
FIG. 8 is a cross-sectional view drawn to an enlarged scale which is similar to FIG. 3 except that the mechanism for adjusting the chair and back rest assembly angle is in a locked state.

The recliner chair 20 is best understood by first referring to FIGS. 2, 3 and 8 of the drawings. On the side of the body support unit 22 there is a hand lever 26 which is attached to a cross-shaft 27. The cross-shaft 27 is pivotally mounted in the body support unit 22. The hand lever 26 is used to lock and unlock the body support unit 22 on the stationary base 21. When the hand lever 26 is extended forwardly, as shown in FIGS. 2 and 3, the body support unit 22 is unlocked from the base 21 and can be adjusted or rocked back and forth on the base 21. When the hand lever 26 is rotated counter-clockwise to a rearward extending position, as shown in phantom in FIG. 8, the body support unit 22 is locked to the base 21.

The base 21 is an open rectangular structure and includes a front wall 28, a pair of side walls 29, a rear wall 30 and a pair of lateral crossmembers 31 and 32. The base 21 surrounds the body support unit 22 which is supported on the base side members 29 by a pair of arcuate members 33 which are attached to the sides of the body support unit 22. The seat 23 of the body support unit 22 includes a front wall 34, a pair of adjoining side walls 35 and a crossmember 36 which adjoins the side walls 35. The back rest 24 which adjoins the seat 23 includes a lower wall 38, a pair of side walls 39, an upper wall 40 and several cross-braces 41 which adjoin the side walls 39.

The rocker structure 25, between the base 21 and the body support unit 22 includes the pair of arcuate members 33, attached to the sides of the body support unit 22, and two large coil springs 42. The coil springs 42 are adjacent to the inner surfaces of the seat side walls 35 and are supported on one of the base crossmembers 32. The upper ends of the springs 42 bear against the seat crossmember 36. When the body support unit 22 is rocked back and forth on the base 22, the coil springs 42 develop counter-torques to balance the rocking forces of the occupant against the back rest 24 of the chair 20.

With reference to FIGS. 4 and 5, a rearward opening U-shaped bracket 43 is fastened to the body control unit 22 and has a pair of side walls 44 and an adjoining front wall 45. Between the side walls 44 there is a cam 46 which is pivotally mounted to the bracket 43. Forwardly adjacent to the cam 46 there is an upward extending T-section arcuate member 47 which is pivotally attached to an upward opening bracket 48 mounted on the base 21. The arcuate member 47 is molded of a durable polymer or some other suitable material. The upward extent of the arcuate member 47 is such that the cam 46 remains adjacent to the arcuate member 47 throughout the travel of the body support unit 22 from the upright to the fully reclining position.

Rearwardly adjacent to the arcuate member 47 and opposite the cam 46 there is a pair of inward extending fingers 49 which are integral with the U-shaped bracket 43. The fingers 49 serve as reaction members and react the force of the cam 46 when the cam 46 is engaged with slender arcuate member 47. Moreover, they eliminate bending stresses in the arcuate member 47. The inner ends of the tabs 49 are spaced apart to receive the center leg 50 of the T-section member 47.

A preferred construction of the cam 46 is shown in FIGS. 4–6. The cam 46 is comprised of a stamped arm portion 51 and an outer cam portion 52 which is molded onto the arm portion 51. One material which has been found to be satisfactory for the outer portion is polyurethane. The outer portion 52 has a cam face 53 which is properly shaped to engage and disengage the cam 46 in locking and unlocking relationship with the base mounted arcuate member 47 when the cam 46 is rotated to force the arcuate member 47 against the reaction fingers 49 of the bracket 43. To further increase the locking force of the cam 47 against the arcuate members, serrations 54 may be provided on the cam face 53 as shown in FIG. 6 or on the adjacent surface of the arcuate member 47.

The cam 46 is connected to an arm 55 which is attached to the cross-shaft 27 that carries the hand lever 26 by a straight spring wire link 56. It will be recognized that the cam 46, wire link 56 and arm 55 form a type of four bar linkage. However, it should be noted that the linkage is not conventional because of the absence of a fixed frame. With reference to FIG. 2, when the hand lever 26 is in the forward extending position and the cam 46 is in unlocking relationship with the arcuate member 47, it will be noted that the wire link 56 is unloaded, straight and is positioned above the pivot axes of the cam 46 and 55 and arm. With reference to FIG. 8, it will be further noted when the hand lever 26 is rearward extending and the cam 46 is in locking relationship with the arcuate member 47, the resilient wire link 56 is below the pivot axes, is under compression and has an arcuate shape, forcing the cam 46 into locking relationship with the arcuate member 47.

Figure 9:
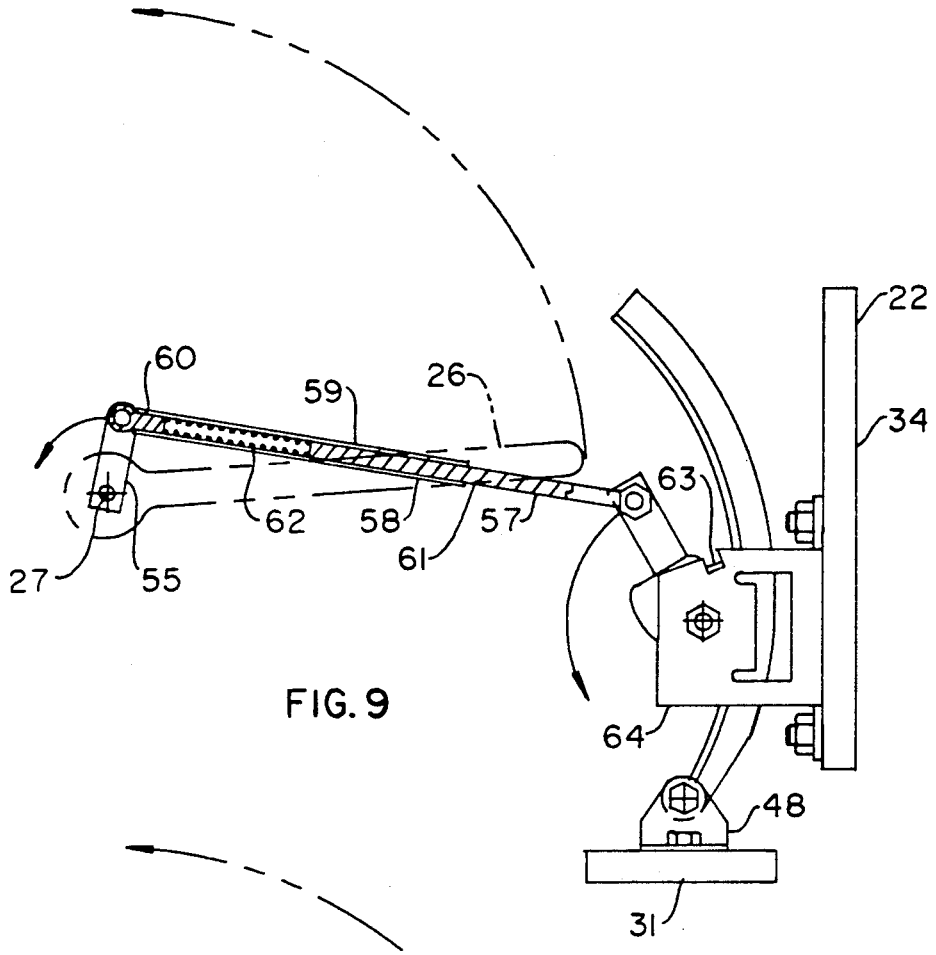
FIG. 9 is a right side view of a first alternate embodiment of the invention.

Referring now to FIG. 9, an alternate embodiment 57 is shown wherein the cam 46 is loaded in both the locking and unlocking relationship with the arcuate member 47 by a rod and tube assembly 58. At one end of a tube 59 there is a fitting 60 which is attached to the arm 55. A rod 61 slideably engages the tube 59 and is attached to the cam 46. Inside of the tube 59, there is a compression spring 62 which loads the cam 46. With this embodiment an integral stop 63 is provided in a bracket 64 to limit the travel of the hand lever 26 in the forward extended position.

Figure 10:
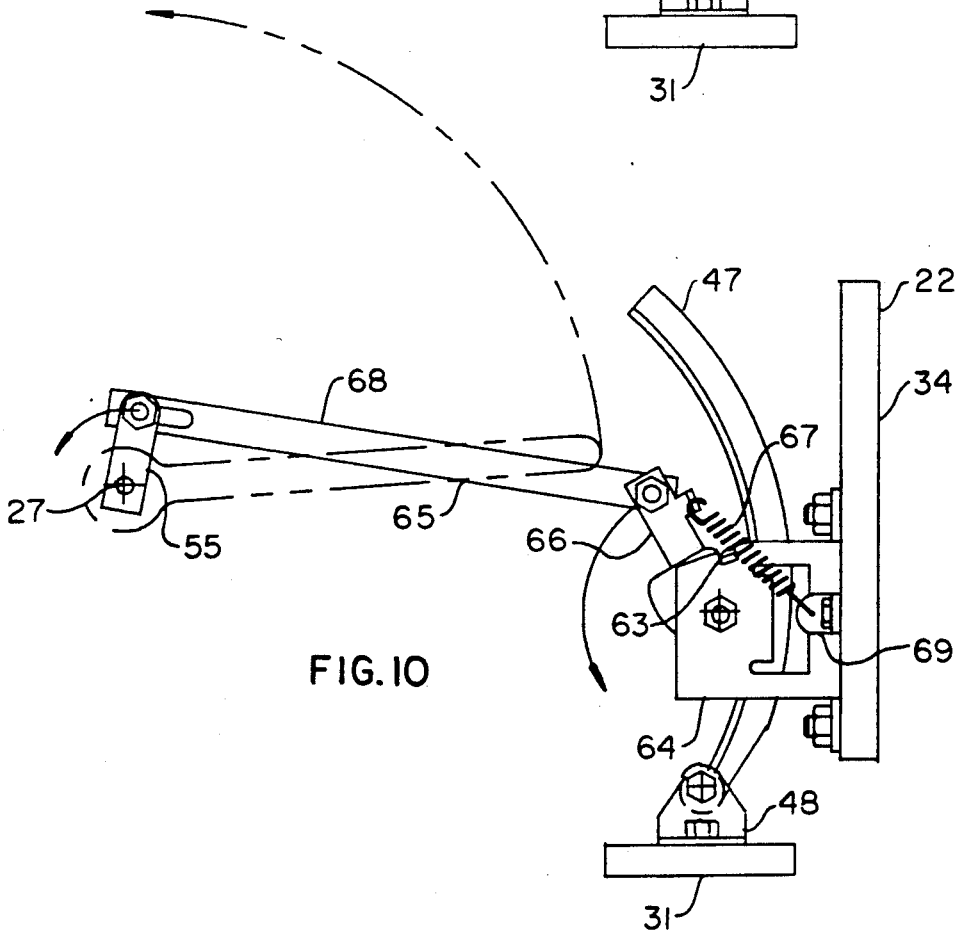
FIG. 10 is a right side view of another alternate embodiment of the invention.

In FIG. 10 is shown another embodiment 65 wherein a rigid link 68 is provided and a cam 66 is loaded in both the locking and unlocking relationship with a coil extension spring 67 which is connected to a tab 68 on the cam 66 and to a small bracket 69 which is fastened to the body support unit 22. For this embodiment 65, the stop 63 is also provided to limit the travel of the hand lever 26 when it is in the forward extended position.

The invention is used in the following manner. To place the chair 20 in the rocking mode or to adjust the angle of the body support unit 22 on the base 21, the hand lever 26 is rotated to the 3:00 o'clock position shown in FIG. 2. A clockwise rotation of the hand lever positions the cam as shown in FIG. 3 and unlocks the body support unit 22 from the base 21. To selectively adjust the body support unit 22, with the hand lever 26 at the 3:00 o'clock position, the body support unit 22 is moved by applying pressure to the back rest 24 with an occupant's body. The hand lever 26 is then rotated counter-clockwise to the 9:00 o'clock position to bring the cam 46 into locking relationship with the arcuate member 47, as shown in FIG. 8, to lock the body support unit 22 to the stationary base 21.

From the foregoing, it is apparent that my invention provides a recliner chair having an operating control means for selectively adjusting a body support unit, including a seat and back rest, on a stationary base which is convenient, easy to use and low in cost. Moreover, my invention is applicable to combination recliner-rocker chairs.

Although but several embodiments of my invention have been illustrated and described, it is not my intention to limit my invention to these embodiments since it will be appreciated that other embodiments can be derived by obvious changes in material, shape, number, and substitution of parts without departing from the spirit thereof.

I claim:

1. An adjustable recliner chair of the type having a body support unit including a seat and back rest mounted on a stationary base and an operative control means for selectively adjusting the position of said body support unit between an upright and fully reclining position of said body support unit on said base, comprising in combination: a stationary base; a movable body support unit including a seat and back rest mounted on said base; a cam pivotally mounted on a forward portion of said body support unit, an upward extending toothless arcuate member forwardly adjacent to said cam, said upward extending member being pivotally mounted on said base and cooperating with said cam to selectively fix by friction said body support unit to said base at any angle between an upright position and a fully reclining position and to release said body support unit from said base; and an operative control means for rotating said cam into a locking and unlocking relationship with said upward extending base mounted member to selectively fix the position of said body support unit on said base between said upright position and said fully reclining position on said base, said control means including a hand lever pivotally mounted in said body support unit.

2. The adjustable recliner chair recited in claim 1 wherein said upward extending base mounted member is of an upward extent to remain adjacent to said cam during the movement of said body support unit on said base between said upright position and said fully reclined position.

3. The adjustable recliner chair recited in claim 1 wherein said control means for bringing said cam into locking and unlocking relationship with said upward extending base mounted member includes a resilient means for compensating wear of said cam and said upward extending arcuate member.

4. The adjustable recliner chair recited in claim 3 wherein said resilient means is a straight slender circular wire spring connected to said cam.

5. The recliner chair recited in claim 3 wherein said means for bringing said cam into locking and unlocking relationship with said upward extending base mounted member comprises an arm operatively connected to said hand lever; and a link interconnecting said arm with said cam.

6. The adjustable recliner chair recited in claim 1 further comprising a rocker structure disposed between said base and said body support unit.

7. The adjustable recliner chair recited in claim 1 further comprising at least one pair of coil springs mounted between said base and said seat and back rest assembly for applying a counter-torque to body support unit during the movement thereof.

8. The adjustable recliner chair recited in claim 1 wherein said cam is comprised of an arm portion and an outer cam portion molded onto said arm portion, said cam portion having a face which is adjacent to said upward extending base mounted member for locking and unlocking said base mounted member.

9. The adjustable recliner chair recited in claim 8 wherein said cam face has a plurality of fine serrations.

10. The adjustable recliner chair recited in claim 8 wherein the surface of said upward extending base mounted member which is adjacent to said cam has a plurality of fine serrations.

11. An adjustable recliner chair of the type having a body support unit including a seat and back rest mounted on a stationary base and an operative control means for selectively adjusting the position of said body support unit between an upright and fully reclining position of said body support unit on said base, comprising in combination: a stationary base; a movable body support unit including a seat and back rest mounted on said base; a reaction member mounted to a forward portion of said body support unit; a cam pivotally mounted on a front portion of said body support unit; a slender upward extending toothless arcuate member mounted for rotation on said base, said arcuate member being disposed forwardly adjacent to said cam and being of an upward extent such that during the movement of said body support unit from said upright to said fully reclining position of said body support unit to remain adjacent to said cam; and an operative control means for rotating said cam to force said upward extending member into frictional locking relationship with said reaction member to lock said body support unit at any angle between an upright position and a fully reclining position, said control means comprising: a hand lever pivotally mounted in said body support unit; an arm operatively connected to said hand lever; and a longitudinal link resiliently interconnecting said arm with said cam to compensate for wear of said upwardly extending member and said cam.

12. The recliner chair recited in claim 11 wherein said longitudinal link is a straight slender circular wire spring.

13. In an adjustable recliner chair of the type having a body support unit including a seat and back rest mounted on a stationary base which is adjustable between an upright and a fully reclining position of said body support unit on said base, the improvement comprising: a slender toothless arcuate member pivotally mounted on said base; a reaction member mounted to said body support unit forwardly adjacent to one side of said slender arcuate member; a cam rearwardly adjacent to an opposite side of said slender arcuate member for forcing said arcuate member into frictional engagement with said reaction member and operative control means for rotating said cam to selectively fix the position of said body support unit on said base between said upright and said fully reclining positions.

14. The improvement recited in claim 13 wherein said operative control means for bringing said cam into locking and unlocking engagement with said slender member is a hand operative means.

* * * * *